US011685169B2

(12) United States Patent
Matsuyama et al.

(10) Patent No.: US 11,685,169 B2
(45) Date of Patent: Jun. 27, 2023

(54) HEAD UNIT, RECORDING HEAD, AND INKJET RECORDING APPARATUS THEREWITH

(71) Applicant: KYOCERA Document Solutions Inc., Osaka (JP)

(72) Inventors: Ryo Matsuyama, Osaka (JP); Hiroyuki Tomioka, Osaka (JP); Koji Tsurusaki, Kyoto (JP); Masaru Iwabuchi, Kyoto (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/670,959

(22) Filed: Feb. 14, 2022

(65) Prior Publication Data

US 2022/0258488 A1 Aug. 18, 2022

(30) Foreign Application Priority Data

Feb. 17, 2021 (JP) ..... JP2021-023392
May 21, 2021 (JP) ..... JP2021-085907
Feb. 7, 2022 (JP) ..... JP2022-016915

(51) Int. Cl.
*B41J 2/175* (2006.01)

(52) U.S. Cl.
CPC ..... *B41J 2/17596* (2013.01)

(58) Field of Classification Search
CPC ..... B41J 29/02; B41J 2/175; B41J 2/18; B41J 2/17596
See application file for complete search history.

(56) References Cited

U.S. PATENT DOCUMENTS 9,327,513 B2 * 5/2016 Moriguchi ..... B41J 2/18
9,855,760 B2 * 1/2018 Sato ..... B41J 2/1652
10,618,305 B2 * 4/2020 Eto ..... B41J 2/17523
2005/0073559 A1 * 4/2005 Aruga ..... B41J 2/14 347/85

FOREIGN PATENT DOCUMENTS

JP 2002-36586 A 2/2002
JP 2006-68994 A 3/2006

* cited by examiner

*Primary Examiner* — An H Do
(74) *Attorney, Agent, or Firm* — Stein IP, LLC

(57) ABSTRACT

A head unit includes a common passage, at least one recording head, and a joint mechanism. The joint mechanism has a first valve and couples the common passage to the recording head. The first valve includes: a first stopper having a switch member with an insertion hole and an engagement boss projecting from its inner surface, a sliding portion inserted in the insertion hole slidably up and down, and an engagement groove engaged with the engagement boss; and a first sealing member fitted on the first stopper to be in contact with or away from the insertion hole's inner surface. Rotating the switch member to move the first stopper up/down causes the first valve to switch between a closed state, with the first sealing member in contact with the insertion hole's inner surface, and an open state, with the first sealing member away from the insertion hole's inner surface.

13 Claims, 13 Drawing Sheets

HEAD UNIT, RECORDING HEAD, AND INKJET RECORDING APPARATUS THEREWITH

INCORPORATION BY REFERENCE

This application is based on and claims the benefit of priority from Japanese Patent Application No. 2021-023392 filed on Feb. 17, 2021, Japanese Patent Application No. 2021-085907 filed on May 21, 2021, and Japanese Patent Application No. 2022-016915 filed on Feb. 7, 2022 the contents of all of which are hereby incorporated by reference.

BACKGROUND

The present disclosure relates to a head unit to be incorporated in an inkjet recording apparatus, to a recording head, and to an inkjet recording apparatus incorporating such a head unit. More particularly, the present disclosure relates to a structure for fitting a recording head to a head unit.

Conventionally, on an inkjet recording apparatus such as an inkjet printer, ink is ejected from ink ejection nozzles provided in a recording head so that the ejected ink attaches to a recording medium such as a paper sheet to form dots. On an inkjet recording apparatus like that, clogging or the like may make it difficult for some of the ink ejection nozzles to eject ink, in which case the recording head needs to be replaced.

On a printer of what is called the line head type, where recording heads are disposed such that ink ejection nozzles are disposed over the entire width of the recording medium, if for each color three recording heads are integrated into a unit, it is comparatively easy to replace the entire head unit. This is because each head unit has a flow passage for liquid such as ink and cleaning liquid that is complete on its own.

Considering however that in most cases it is one recording head that gets broken in a head unit, replacing the entire head unit incurs extra cost. It is therefore desirable that only the broken recording head be replaced. Replacing only one recording head, however, requires shutting off the flow passage for the liquid and may lead to leakage of the liquid.

SUMMARY

According to one aspect of the present disclosure, a head unit includes a common flow passage, at least one recording head, and a joint mechanism, and is incorporated in an inkjet recording apparatus for the recording of an image to a recording medium. The common flow passage has a liquid feed passage through which to pass at least one kind of liquid including ink. The recording head is attachable and detachable to and from the common flow passage, and has a plurality of nozzles through which to eject the ink. The joint mechanism has a first valve that opens and closes the liquid feed passage, and couples the liquid feed passage to the recording head. The first valve includes a switch member, a first stopper member, and a first sealing member. The switch member has an insertion hole and an engagement boss projecting from the inner circumferential surface of the insertion hole. The first stopper member has a sliding portion inserted in the insertion hole so as to be slidable up and down and an engagement groove formed with an inclination relative to the axial direction of the sliding portion so as to be engaged with the engagement boss. The first sealing member is attached to the first stopper member so as to be in contact with or away from the inner circumferential surface of the insertion hole. Rotating the switch member and thereby moving the first stopper member up and down causes the first valve to switch between a closed state where the first sealing member is in contact with the inner circumferential surface of the insertion hole and an open state where the first sealing member is away from the inner circumferential surface of the insertion hole

DETAILED DESCRIPTION

Figure 1:
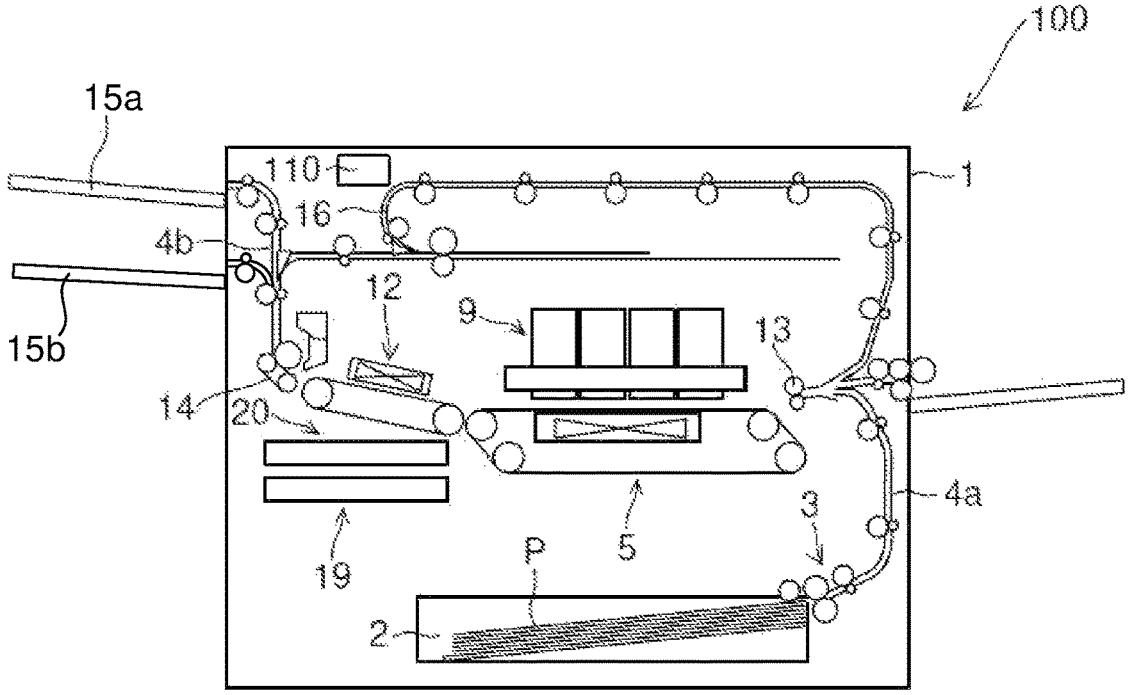
FIG. 1 is an illustrative diagram showing an outline of the construction of a printer as an inkjet recording apparatus according to one embodiment of the present disclosure.

1. Construction of an Inkjet Recording Apparatus: With reference to the accompanying drawings, an embodiment of the present disclosure will be described below. FIG. 1 is an illustrative diagram showing an outline of the construction of a printer 100 as an inkjet recording apparatus according to an embodiment of the present disclosure. The printer 100 includes a sheet feed cassette 2 as a sheet storage unit. The sheet feed cassette 2 is disposed in a lower part inside a printer body 1. Inside the sheet feed cassette 2, sheets P as one example of a recording medium are stored.

Downstream of the sheet feed cassette 2 in the sheet conveying direction, that is, to the upper right of the sheet feed cassette 2 in FIG. 1, a sheet feeding device 3 is disposed. The sheet feeding device 3 feeds out sheets P, one by one separately, to the upper right of the sheet feed cassette 2 in FIG. 1.

The printer 100 includes, inside it, a first sheet conveying passage 4*a*. The first sheet conveying passage 4*a* is located to the upper right of the sheet feed cassette 2, that is, in its sheet feed direction. A sheet P fed out from the sheet feed cassette 2 is conveyed through the first sheet conveying passage 4*a*, vertically upward along a side surface of the printer body 1.

At the downstream end of the first sheet conveying passage 4*a* in the sheet conveying direction, a pair of registration rollers 13 is provided. Closely downstream of the pair of registration rollers 13 in the sheet conveying direction, a first conveying unit 5 and a recording unit 9 are disposed. The sheet P fed out from the sheet feed cassette 2 passes through the first sheet conveying passage 4*a* and reaches the pair of registration rollers 13. The pair of registration rollers 13, while correcting skew in the sheet P and coordinating with the ink ejection operation performed by the recording unit 9, feeds out the sheet P toward the first conveying unit 5 (in particular, a first conveying belt 8, described later).

The sheet P fed into the first conveying unit 5 by the pair of registration rollers 13 is conveyed by the first conveying belt 8 to a position opposite the recording unit 9 (in particular, recording heads 17*a* to 17*c*, described later). From the recording unit 9, ink is ejected onto the sheet P, so that an image is recorded on the sheet P. At this time, the ejection of ink in the recording unit 9 is controlled by a control device 110 within the printer 100.

Downstream of (in FIG. 1, to the left of) the first conveying unit 5 in the sheet conveying direction, a second conveying unit 12 is disposed. The sheet P having an image recorded on it by the recording unit 9 is fed to the second conveying unit 12. During the passage through the second conveying unit 12, the ink ejected onto the surface of the sheet P is dried.

Downstream of the second conveying unit 12 in the sheet conveying direction, near the left side surface of the printer body 1, a decurler unit 14 is provided. The sheet P having the ink on it dried by the second conveying unit 12 is fed to the decurler unit 14, where a curl that has developed in the sheet P is corrected.

Downstream of (in FIG. 1, over) the decurler unit 14 in the sheet conveying direction, a second sheet conveying passage 4*b* is provided. The sheet P that has passed through the decurler unit 14, when it is not subjected to duplex recording, passes through the second sheet conveying passage 4*b* and is discharged onto a sheet discharge tray 15*a* provided outside the left side surface of the printer 100. Under the sheet discharge tray 15*a*, a sub discharge tray 15*b* is provided onto which sheets P such as those having failed to be printed properly are discharged In an upper part of the printer body 1, over the recording unit 9 and the second conveying unit 12, a reverse conveying passage 16 for duplex recording is provided. When duplex recording is performed, a sheet P having undergone recording on its one side (first side) and having passed through the second conveying unit 12 and the decurler unit 14 passes through the second sheet conveying passage 4*b* to be fed to the reverse conveying passage 16.

The sheet P fed to the reverse conveying passage 16 has its conveying direction switched for subsequent recording on its other side (second side). The sheet P then passes rightward across an upper part of the printer body 1 so that the sheet P then passes through the pair of registration rollers 13 and is fed, with the second side up, once again to the first conveying unit 5. In the first conveying unit 5, the sheet P is conveyed to a position opposite the recording unit 9, and from the recording unit 9, ink is ejected so that an image is formed on the second side. The sheet P having undergone duplex recording passes through the second conveying unit 12, the decurler unit 14, and the second sheet conveying passage 4*b* in this order and is discharged onto the sheet discharge tray 15.

Under the second conveying unit 12, a maintenance unit 19 and a capping unit 20 are disposed. When purging is performed, the maintenance unit 19 moves horizontally to under the recording unit 9, where the maintenance unit 19 wipes off and collects the ink forced out of ink ejection apertures in the recording heads. Purging denotes operation in which ink is forcibly driven out of the ink ejection apertures in the recording heads to discharge ink with increased viscosity, foreign matter, and air bubbles out of the ink ejection apertures. When capping is performed on the ink ejection surface of the recording heads, the capping unit 20 moves horizontally to under the recording unit 9 and then moves up to be fitted on the bottom surface of the recording heads.

Figure 2:
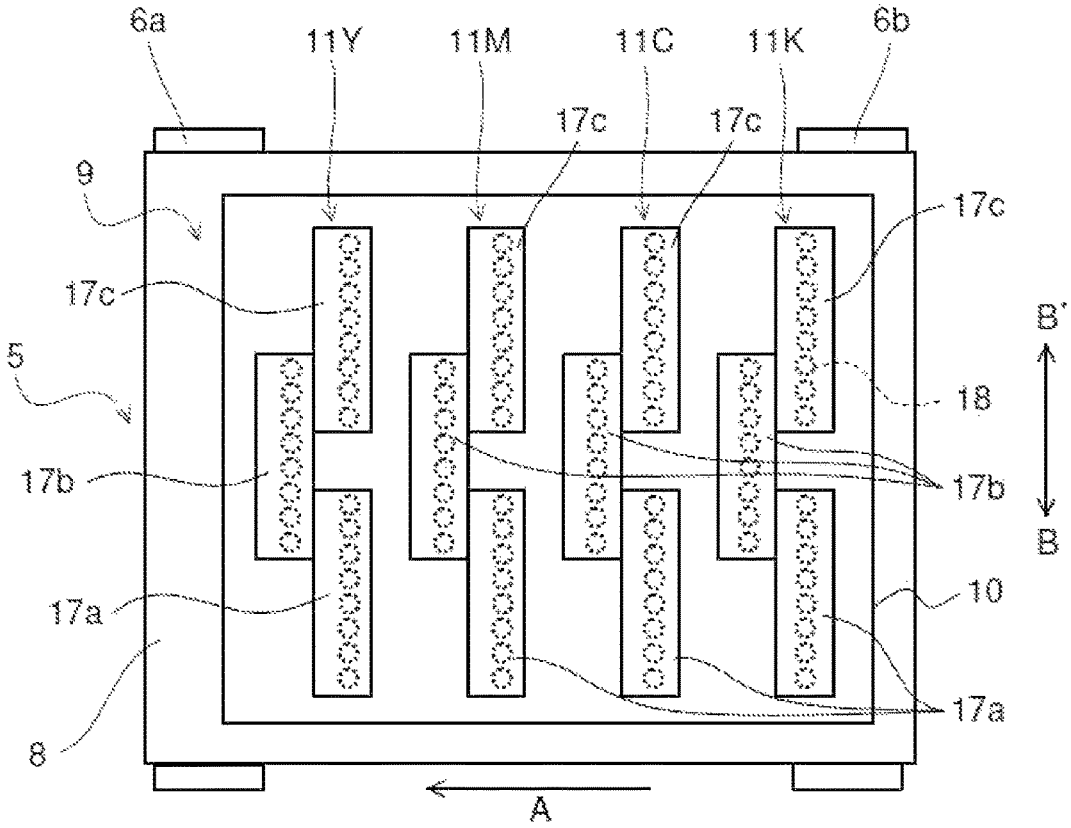
FIG. 2 is a plan view of a recording unit provided in the printer.

FIG. 2 is a plan view of the recording unit 9. The recording unit 9 includes a head housing 10 and line heads 11Y, 11M, 11C, and 11K. The line heads 11Y to 11K are held on the head housing 10 at such a height as to leave a predetermined gap (e.g., 1 mm) from the conveyance surface of a first conveying belt 8 that is an endless belt stretched around a plurality of rollers, which include a driving roller 6*a*, a driven roller 6*b*, and tension rollers 7*a* and 7*b* (not shown). The driving roller 6*a* makes the first conveying belt 8 move around in the conveying direction (the direction indicated by arrow A) of sheets P.

The line heads 11Y to 11K each include a plurality of (here, three) recording heads 17*a* to 17*c*. The recording heads 17*a* to 17*c* are disposed in a staggered array along the sheet width direction (the direction indicated by arrows BB') orthogonal to the sheet conveying direction (the direction indicated by arrow A). The recording heads 17*a* to 17*c* have a plurality of ink ejection apertures 18 (nozzles). The ink ejection apertures 18 are disposed in rows at equal intervals in the width direction of the recording heads, that is, in the sheet width direction (the direction indicated by arrows BB'). From the line heads 11Y to 11K, through the ink ejection apertures 18 in the recording heads 17*a* to 17*c*, inks of different colors, namely yellow (Y), magenta (M), cyan (C), and black (K) respectively, are ejected toward a sheet P conveyed on the first conveying belt 8.

Figure 3:
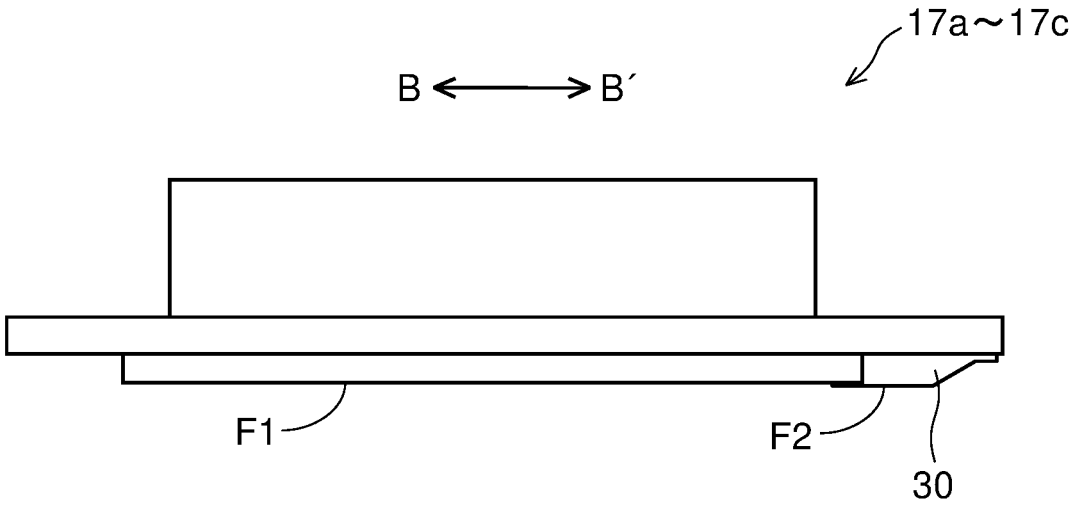
FIG. 3 is a side view of a recording head in a line head in the recording unit.
Figure 4:
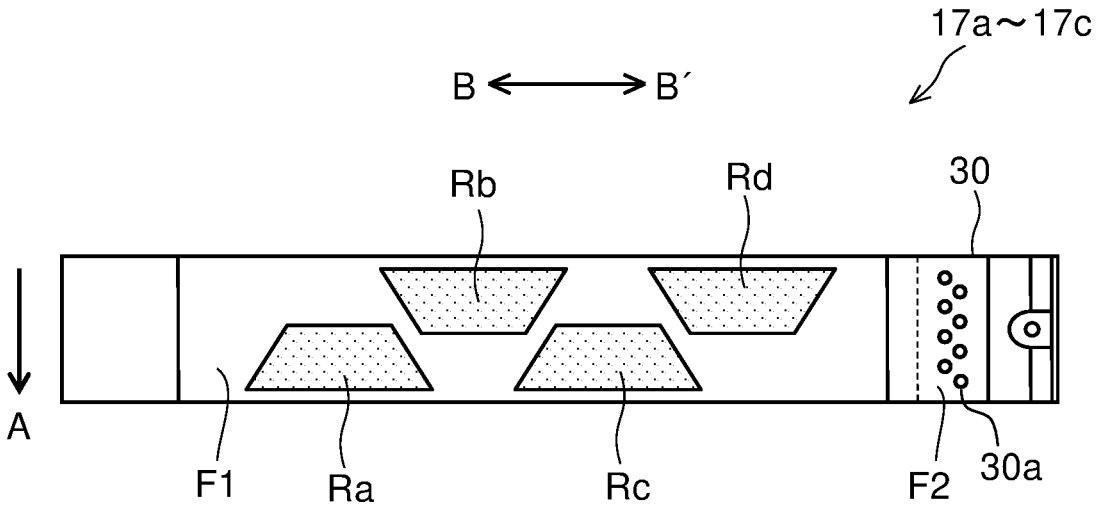
FIG. 4 is a plan view of the recording head as seen from its ink ejection surface side.

FIG. 3 is a side view of the recording head 17*a* to 17*c* in the line head 11Y to 11K in the recording unit 9, and FIG. 4 is a plan view of the recording head 17*a* to 17*c* as seen from its ink ejection surface F1 side. The recording heads 17*a* to 17*c* are identically shaped and identically structured, and accordingly in FIGS. 3 and 4 they are represented by one of them. As shown in FIGS. 3 and 4, on the ink ejection surface (nozzle surface) F1 of the recording head 17*a* to 17*c*, a plurality of nozzle regions Ra to Rd (here, in four blocks) each having a number of ink ejection apertures 18 (see FIG.

2) arrayed in it are provided. The ink ejection surface F1 is formed of, for example, SUS (stainless steel).

The recording heads 17*a* to 17*c* in the line heads 11C to 11K are fed with inks of four colors (cyan, magenta, yellow, and black) each from a liquid feeding mechanism 50 (see FIG. 5) such that the line heads 11C to 11K are fed with the inks of the corresponding colors.

In response to a control signal from the control device 110 (see FIG. 1), in accordance with image data received from an external computer, the recording heads 17*a* to 17*c* eject ink toward a sheet P conveyed in a state held by suction on the conveyance surface of the first conveying belt 8. Thus, on the sheet P on the first conveying belt 8, a color image is formed that has inks of four colors, namely cyan, magenta, yellow, and black, overlaid on each other. In one end part of each of the recording heads 17*a* to 17*c* in its longitudinal direction (the direction indicated by arrows BB') orthogonal to the sheet conveyance direction (the direction indicated by arrow A), a cleaning liquid feeding portion 30 is provided that feeds cleaning liquid. The cleaning liquid feeding portion 30 has a number of cleaning liquid feed apertures 30*a* formed in it.

On the printer 100, to clean the ink ejection surface F1 of the recording head 17*a* to 17*c*, when printing is started after a long period of disuse and between sessions of printing operation, recovery operation for the recording head 17*a* to 17*c* is performed in preparation for the subsequent printing operation. In the recovery operation, ink is forced (purged) out of all the ink ejection apertures 18 in the recording heads 17*a* to 17*c*, and cleaning liquid is fed through the cleaning liquid feed apertures 30*a* to a cleaning liquid feeding surface F2. After that, with wipers (not shown), the ink ejected onto the ink ejection surface F1 is wiped off along with the cleaning liquid. The ink and cleaning liquid wiped off from the ink ejection surface F1 are collected in an ink pan (not shown).

Figure 5:
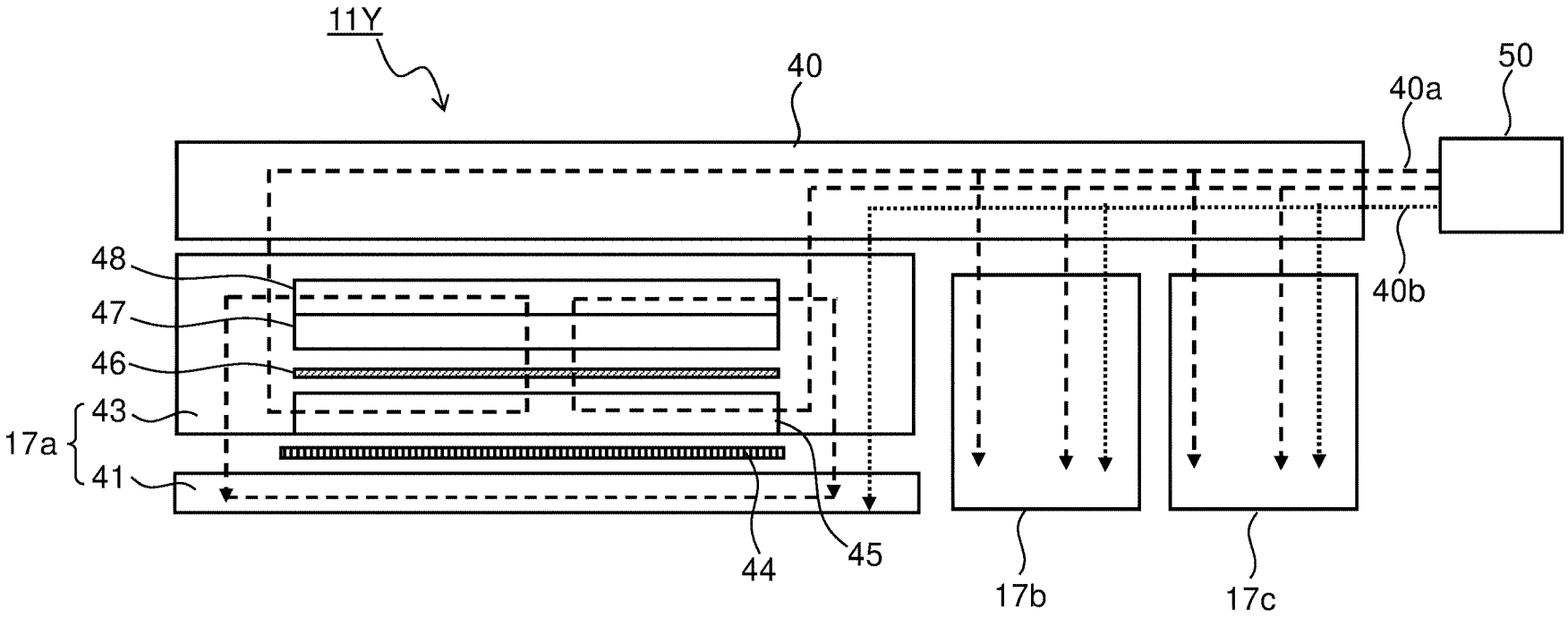
FIG. 5 is a schematic diagram showing ink feed passages, a cleaning liquid feed passage, and the internal structure of recording heads in a line head in the printer.

FIG. 5 is a schematic diagram showing ink feed passages, a cleaning liquid feed passage, and the internal configuration of the recording heads 17*a* and 17*c* in the line head 11Y in the printer 100. The line heads 11M to 11K are identically configured, and accordingly no overlapping description will be repeated. The recording heads 17*a* to 17*c* have an identical internal configuration, and accordingly FIG. 5 only shows the internal configuration of the recording head 17*a*.

As shown in FIG. 5, to the recording heads 17*a* to 17, a common flow passage 40 is connected through which ink and cleaning liquid pass. The common flow passage 40 has formed in it two ink feed passages 40*a* through which ink passes and one cleaning liquid feed passage 40*b* through which cleaning liquid passes. The upstream ends of the ink feed passages 40*a* and the cleaning liquid feed passage 40*b* are connected to the liquid feeding mechanism 50. The liquid feeding mechanism 50 is composed of tanks for storing ink and cleaning liquid and pumps for raising ink and cleaning liquid from those tanks (none is shown).

The two ink feed passages 40*a*, at their downstream ends, branch each into three passages and hance into a total of six passages, of which every two are connected to the ink ejection apertures 18 of one of the recording heads 17*a* to 17*c*. The cleaning liquid feed passage 40*b*, at its downstream end, branches into three passages, which are each connected to the cleaning liquid feeding portion 30 (see FIGS. 3 and 4) of one of the recording heads 17*a* to 17*c*. A unit that comprises recording heads 17*a* to 17*c* and a common flow passage 40 will in the following description be referred to as a head unit 51 (see FIG. 6).

The recording head 17*a* to 17*c* has a head front portion 41, a head rear portion 43, and a heater 44. In the head front portion 41, there are provided the ink ejection surface F1 in which a number of ink ejection apertures 18 are arrayed and the cleaning liquid feeding portion 30 that feeds cleaning liquid (for both, see FIG. 4).

The head rear portion 43 includes an ink heating flow passage 45, a filter 46, a reservoir tank 47, and a damper 48. The ink feed passages 40*a* pass through the ink heating flow passage 45, then the filter 46, then the reservoir tank 47, then the damper 48 in this order, and then connects to the ink ejection apertures 18 in the head front portion 41.

Between the head front portion 41 and the head rear portion 43, the heater 44 is disposed. The heater 44 heats, as necessary, the ink in the ink heating flow passage 45 (described later) to a predetermined temperature, and heats the head front portion 41 for smooth ejection of ink through the ink ejection apertures 18.

The ink heating flow passage 45 heats the ink in the ink feed passages 40*a* to a predetermined temperature. The ink heating flow passage 45 is provided in the head rear portion 43, at a position adjacent to the heater 44. The filter 46 removes foreign matter from the ink passing through the ink feed passages 40*a*. The reservoir tank 47 temporarily stores the ink passing through the ink feed passages 40*a*. The damper 48 is formed of flexible resin film, and making the damper 48 pulsate permits ink to be forced out to the head front portion 41.

Of the two ink feed passages 40*a*, one is used to feed ink from the liquid feeding mechanism 50 to the recording heads 17*a* to 17*c* and the other is used to collect ink from the recording heads 17*a* to 17*c* to the liquid feeding mechanism 50. For the recording of an image that requires ejection of a large amount of ink, the two ink feed passages 40*a* can both be used to feed ink to the recording heads 17*a* to 17*c*.

Figure 6:
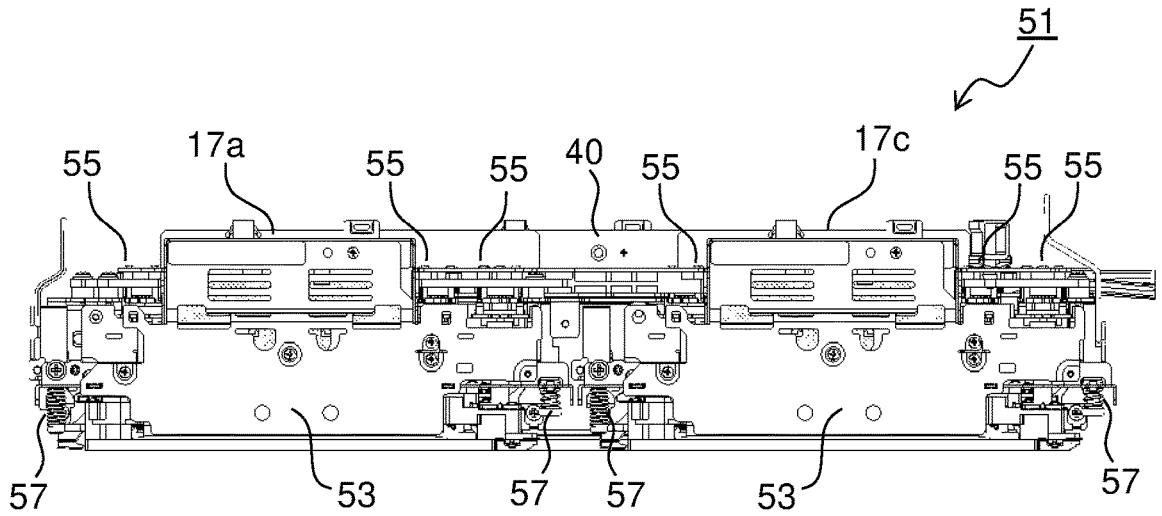
FIG. 6 is a side view of the head unit as seen from upstream in the sheet conveyance direction.
Figure 7:
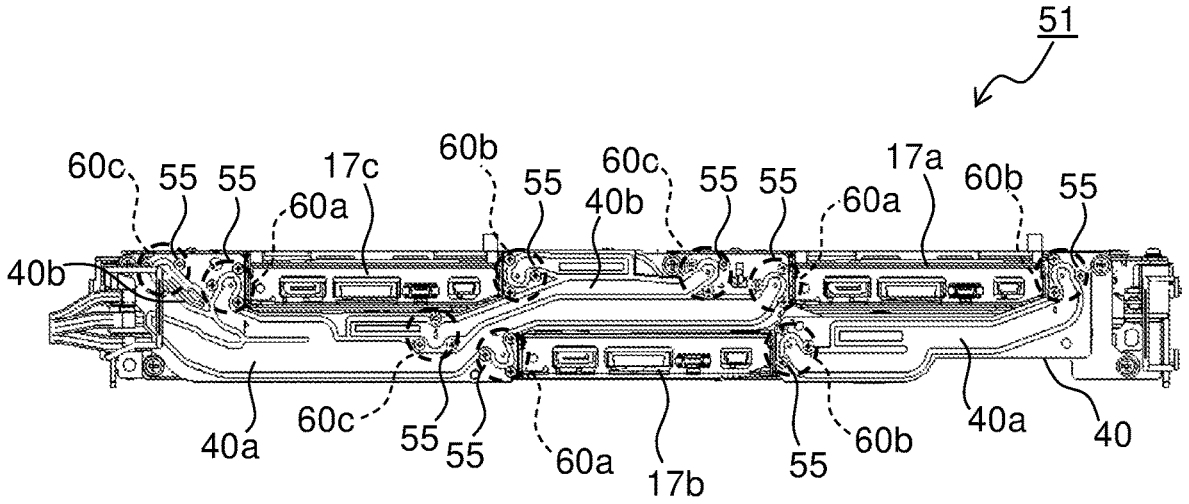
FIG. 7 is a plan view of the head unit as seen from above.
Figure 8:
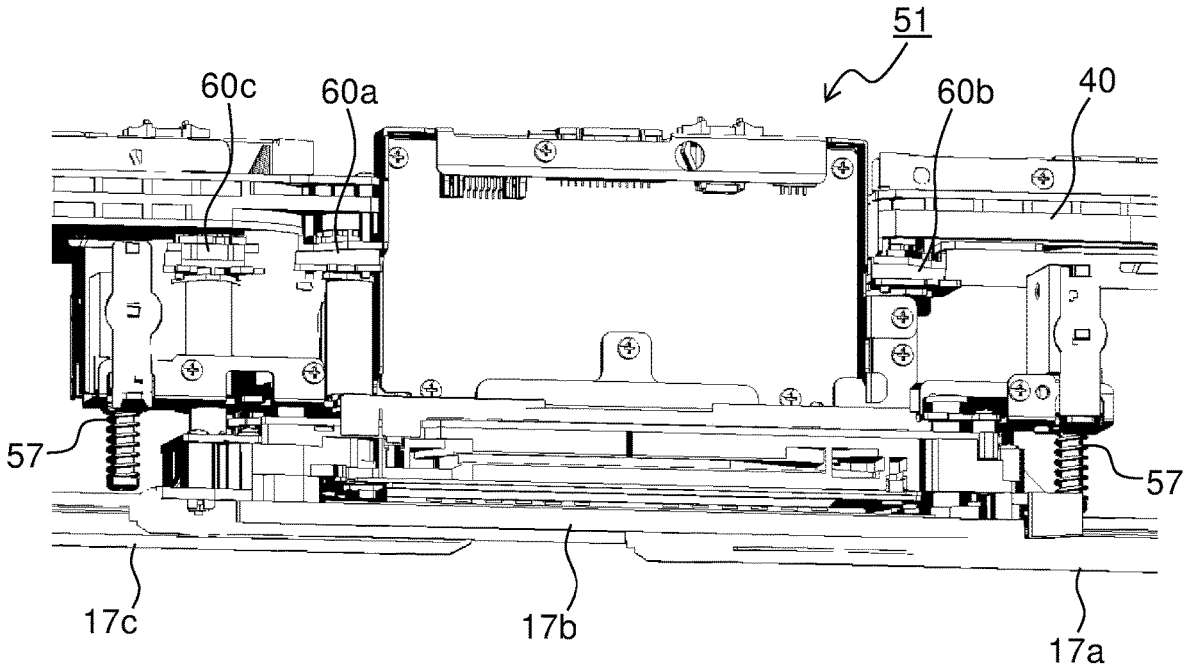
FIG. 8 is an enlarged part view around the recording head in the head unit.

FIG. 6 is a side view of the head unit 51 as seen from upstream in the sheet conveyance direction (i.e., from the right side in FIG. 2). FIG. 7 is a plan view of the head unit 51 as seen from above. FIG. 8 is an enlarged part view around the recording head 17*b* in the head unit 51. The recording heads 17*a* to 17*c* are individually attachable and detachable to and from the common flow passage 40. Specifically, the recording heads 17*a* to 17*c* are connected to the common flow passage 40 at three locations by joint mechanisms 60*a* to 60*c*, which are fastened to the common flow passage 40 from above it with three first fixing screws 55 at each of those locations (with a total of nine of them). Moreover, the recording heads 17*a* to 17*c* are, in their respective opposite, i.e., left and right, end portions, fastened to the common flow passage 40 with second fixing screws 57. The recording heads 17*a* to 17*c* are each, on a side face, fitted with a heatsink plate 53. The heatsink plate 53 rejects the heat generated in the flexible circuit board (not shown) disposed inside.

The joint mechanisms 60*a* and 60*b* are connected respectively to the two ink feed passages 40*a* (see FIG. 7). The joint mechanism 60*c* is connected to the cleaning liquid feed passage 40*b*.

Figure 9:
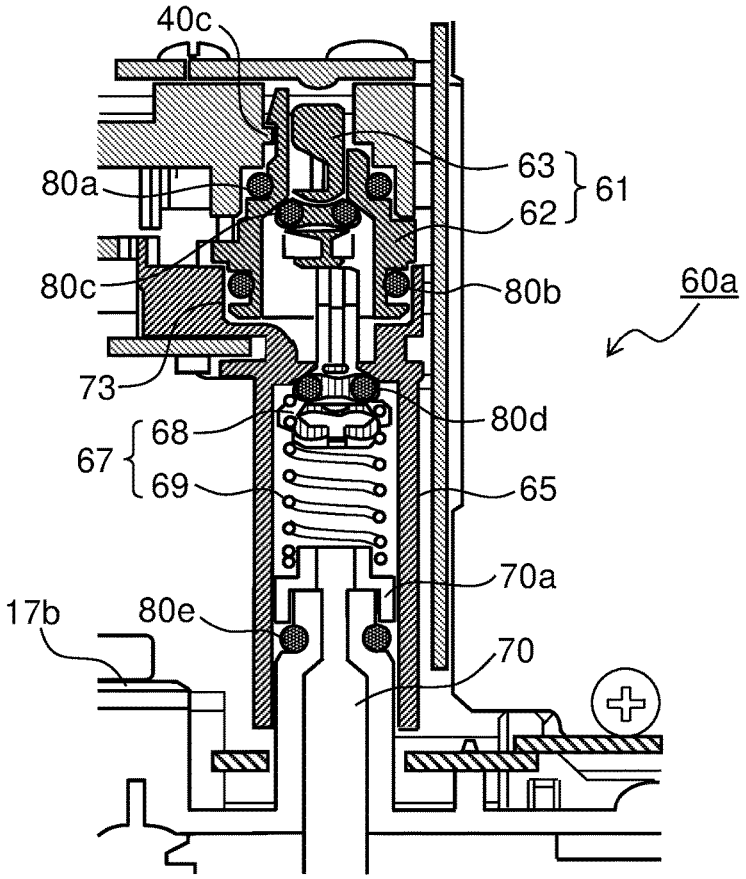
FIG. 9 is a sectional side view of a joint mechanism in the recording head.
Figure 10:
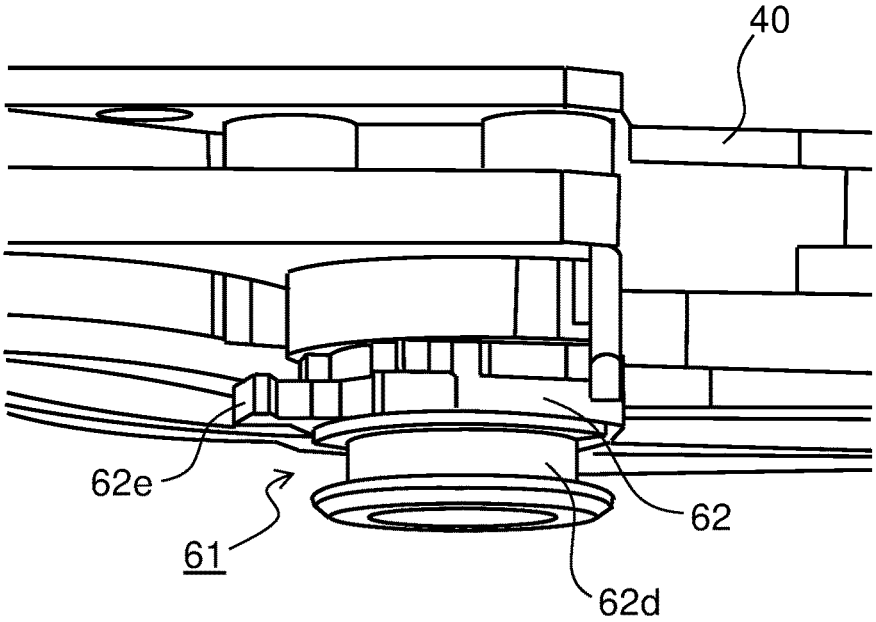
FIG. 10 is a perspective view showing a state with a first valve attached to a common flow passage.
Figure 11:
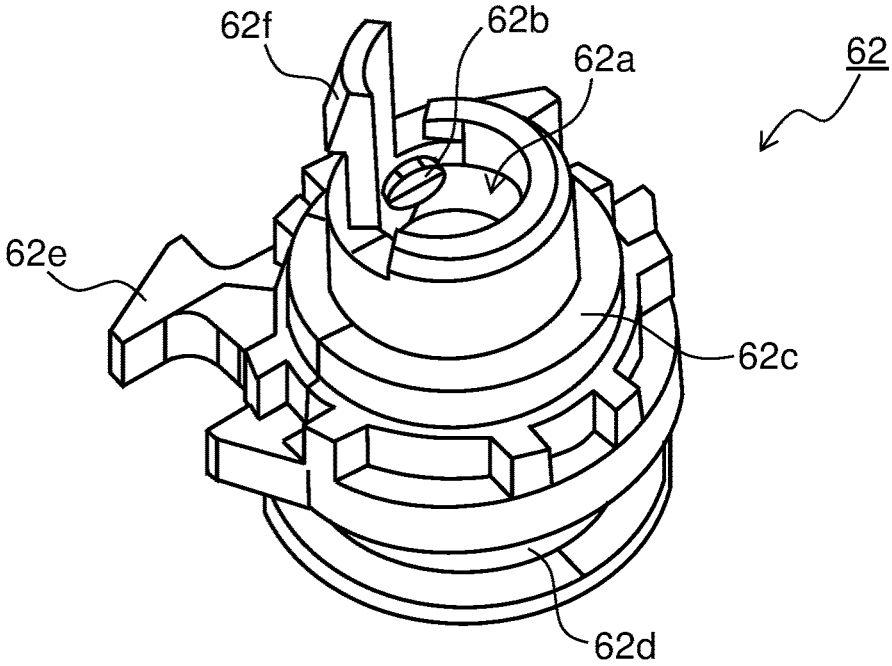
FIG. 11 is a perspective view of a switch member in the first valve
Figure 12:
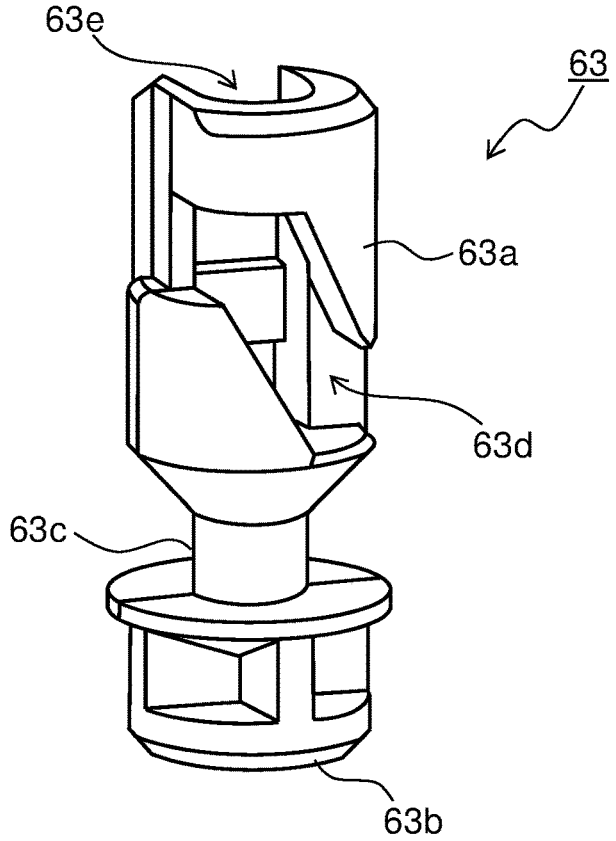
FIG. 12 is a perspective view of a first stopper member in the first valve.
Figure 13:
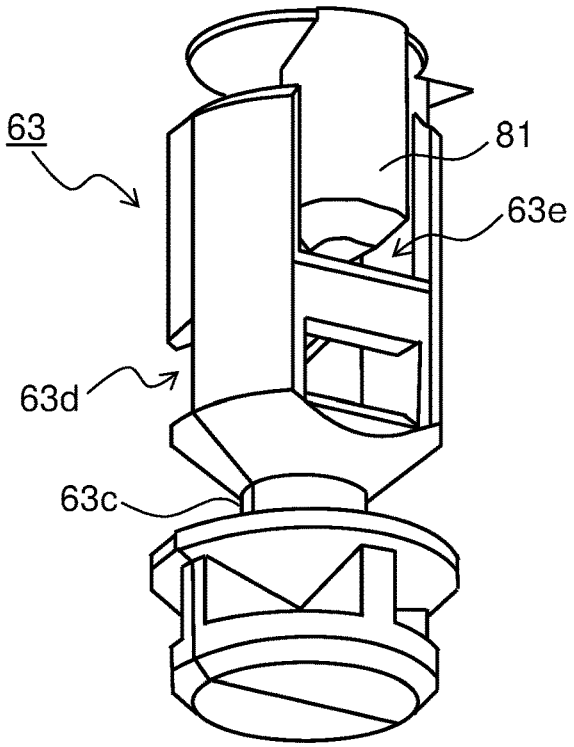
FIG. 13 is a perspective view showing a state in which a guide groove in the first stopper member is engaged with a rotation restricting rib.
Figure 14:
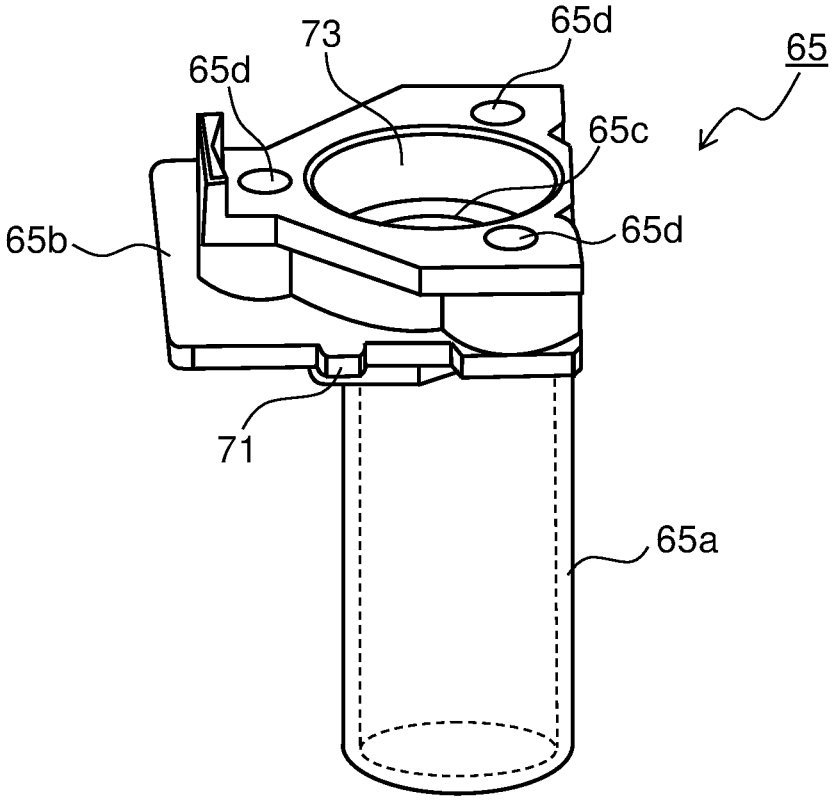
FIG. 14 is a perspective view of a coupling member.

2. Structure of the Joint Mechanism: Now the structure of the joint mechanisms 60*a* to 60*c* will be described in detail. FIG. 9 is a sectional side view of the joint mechanism 60*a* in the recording head 17*b*. FIG. 10 is a perspective view showing a state with a first valve 61 attached to the common flow passage 40. FIG. 11 is a perspective view showing a switch member 62 in the first valve 61. FIG. 12 is a perspective view of a first stopper member 63 in the first valve 61. FIG. 13 is a perspective view showing a state with a guide groove 63*e* in the first stopper member 63 engaged with a rotation restricting rib 81. FIG. 14 is a perspective view of a coupling member 65. While the following description deals with an example of the structure of the joint mechanism 60*a* in the recording head 17*b*, the joint mechanisms 60*b* and 60*c* are structured identically with the joint mechanism 60*a*. The joint mechanisms 60*a* to 60*c* in the recording heads 17*a* and 17*c* are structured identically with those in the recording head 17*b*.

As shown in FIG. 9, the joint mechanism 60*a* includes a first valve 61, a coupling member 65, and a second valve 67. The first valve 61 is attached to the terminal end of one of the ink feed passages 40*a* and the cleaning liquid feed passage 40*b* (see FIG. 7) in the common flow passage 40. The first valve 61 has a switch member 62 and a first stopper member 63.

As shown in FIG. 11, the switch member 62 is substantially in the shape of a hollow cylinder of which the diameter decreases stepwise upward, and has an insertion hole 62*a* in which the first stopper member 63 is inserted. On the inner circumferential surface of the insertion hole 62*a*, an engagement boss 62*b* is formed so as to project from it. On the outer circumferential surface of the switch member 62, there are formed a first flange portion 62*c*, a second flange portion 62*d*, and a lever portion 62*e*. The first flange portion 62*c* is fitted with a first O-ring 80*a* (see FIG. 9) that seals the gap between the common flow passage 40 and the switch member 62. The second flange portion 62*d* is fitted with a second O-ring 80*b* (see FIG. 9) that seals the gap between the first valve 61 and the coupling member 65. The lever portion 62*e* is pressed in the circumferential direction when the switch member 62 is rotated to open and close the first valve 61.

On a top end part of the switch member 62, an engagement claw 62*f* is formed. The engagement claw 62*f* engages with an engaged portion 40*c* (see FIG. 9) inside the common flow passage 40 and thereby, with the recording head 17*a* to 17*c* removed as shown in FIG. 10, prevents the switch member 62 from dropping out.

As shown in FIG. 12, the first stopper member 63 has a sliding portion 63*a*, a pressing portion 63*b*, and a small-diameter portion 63*c*. The sliding portion 63*a* is substantially in a cylindrical shape, and is inserted in the insertion hole 62*a* in the switch member 62 so as to be slidable in the up-down direction. On the outer surface of the sliding portion 63*a*, an engagement groove 63*d* and a guide groove 63*e* are formed. The engagement groove 63*d* is formed with an inclination relative to the axial direction of the sliding portion 63*a* (i.e., the up-down direction), and is engaged with the engagement boss 62*b* (see FIG. 11) on the switch member 62. The guide groove 63*e* is formed at a position opposite the engagement groove 63*d*, parallel to the axial direction (up-down direction).

FIG. 13 is a perspective view showing a state with the guide groove 63*e* in the first stopper member 63 engaged with the rotation restricting rib 81. On the bottom surface of the common flow passage 40 (see FIG. 10), the rotation restricting rib 81 is formed so as to project from it. As shown in FIG. 13, with the first valve 61 fitted to the common flow passage 40, the guide groove 63*e* in the first stopper member 63 engages with the rotation restricting rib 81.

The pressing portion 63*b* is provided in a bottom end part of the first stopper member 63, and makes contact with a tip end part 68*a* (see FIG. 15) of a second stopper member 68. The small-diameter portion 63*c* is formed between the sliding portion 63*a* and the pressing portion 63*b*. The small-diameter portion 63*c* is fitted with a third O-ring 80*c* (see FIG. 9; a first sealing member) that, with the first valve 61 closed, makes contact with the inner surface of the insertion hole 62*a* in the switch member 62.

As shown in FIG. 14, the coupling member 65 has a body portion 65*a* in the shape of a hollow cylinder open in a top and a bottom end part of it, and a support plate 65*b* fixed near the top end part of the body portion 65*a* so as to lie on a horizontal plane orthogonal to the axial direction. The top end part of the body portion 65*a* is coupled to the first valve 61 (see FIG. 9). The bottom end part of the body portion 65*a* is coupled to an ink feed port 70 (see FIG. 9) in the recording head 17*b*.

Near the top end part of the body portion 65*a*, a liquid passage port 65*c* is formed. Inside the body portion 65*a*, the second valve 67 (see FIG. 9) is disposed. The second valve 67 has a second stopper member 68, and a coil spring 69 that urges the second stopper member 68 upward. The liquid passage port 65*c* has an inner diameter smaller than that of the other part of the body portion 65*a* so that, when the second stopper member 68 is pressed against it under the urging force of the coil spring 69, the ink flow passage inside the coupling member 65 is closed. The second stopper member 68 is fitted with a fourth O-ring 80*d* (see FIG. 9; a second sealing member) that makes contact with a circumferential edge part of the liquid passage port 65*c*.

The tip end part 68*a* of the second stopper member 68 protrudes upward through the liquid passage port 65*c* in the coupling member 65, and makes contact with the pressing portion 63*b* of the first stopper member 63. A bottom end part of the coil spring 69 is fixed to a spring seat 70*a* formed in the ink feed port 70 in the recording head 17*b*. The ink feed port 70 is fitted with a fifth O-ring 80*e* (see FIG. 9) that seals the gap between the coupling member 65 and the ink feed port 70.

In the top surface of the body portion 65*a*, at three locations, screw holes 65*d* are formed to which the first fixing screws 55 are fastened. Fastening the first fixing screws 55 to the screw holes 65*d* results in, as shown in FIG. 9, the coupling member 65 being fixed at a position (coupled position) connected to the first valve 61.

Between the top surface of the body portion 65*a* and the liquid passage port 65*c*, a liquid reservoir portion 73 is formed. As shown in FIG. 9, the liquid reservoir portion 73 has a diameter greater than that of the part below the liquid passage port 65*c*, and has a volume equal to or greater than that of the space between the first and second valves 61 and 67. On a side end part of the support plate 65*b*, a projection 71 is formed. The projection 71 protrudes out through an opening 53*a* (see FIG. 17) formed in the heatsink plate 53.

Figure 15:
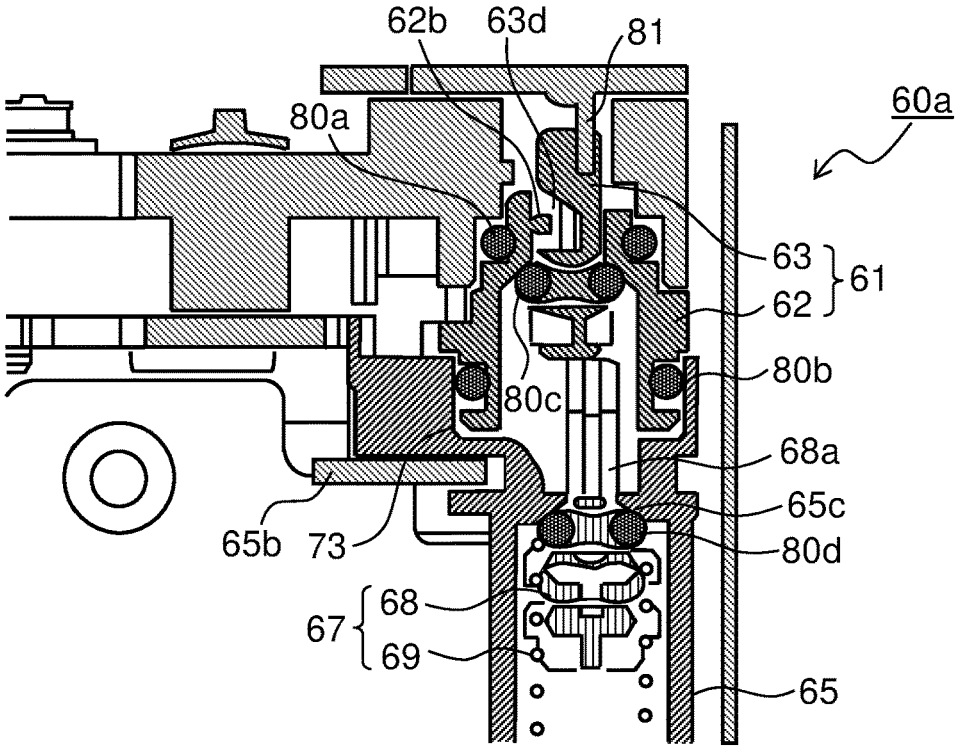
FIG. 15 is a sectional side view of the joint mechanism, showing a state where the first and a second valve are closed.
Figure 16:
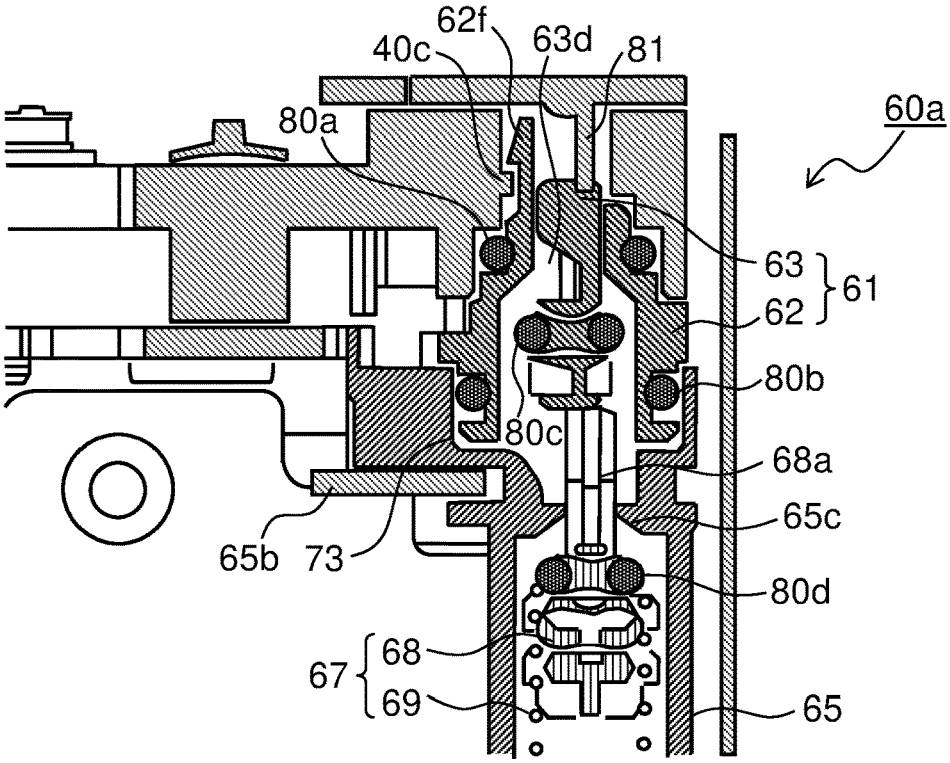
FIG. 16 is a sectional side view of the joint mechanism, showing a state where the first and the second valve are open.

Next, a description will be given of the opening and closing operation of the first and second valves 61 and 67. FIGS. 15 and 16 are each a sectional side view of the joint mechanism 60*a*, showing respectively a state where the first and second valves 61 and 67 are closed and a state where they are open.

In the state shown in FIG. 15, the engagement boss 62*b* of the switch member 62 is located in a bottom end part of the engagement groove 63*d*. In this state, the third O-ring 80*c* fitted on the first stopper member 63 is pressed against the inner wall surface of the insertion hole 62*a* in the switch member 62, keeping the first valve 61 closed.

In the state in FIG. 15, where the first valve 61 is closed, the second stopper member 68 is pressed upward under the urging force of the coil spring 69. Thus the fourth O-ring 80*d* fitted on the second stopper member 68 is pressed against the circumferential edge part of the liquid passage port 65*c*, keeping the second valve 67 closed.

To open the first valve 61, from the state in FIG. 15, the lever portion 62*e* of the switch member 62 is pressed in the circumferential direction with the tip of a screwdriver or the like so as to rotate the switch member 62 in a predetermined direction (clockwise in FIG. 11). Here, the first stopper member 63 is restrained from rotating by the engagement of the guide groove 63*e* with the rotation restricting rib 81. Thus the engagement boss 62*b* on the switch member 62 moves across inside the engagement groove 63*d* in the first stopper member 63, from a bottom end part to a top end part of it. Since the switch member 62 is fixed to the common flow passage 40, as the engagement boss 62*b* moves, the first stopper member 63 moves down. As a result, as shown in FIG. 16, the third O-ring 80*c* fitted on the first stopper member 63 moves apart from the inner wall surface of the insertion hole 62*a*, leaving the first valve 61 open. The first stopper member 63, owing to the guide groove 63*e* and the rotation restricting rib 81 sliding relative to each other, moves smoothly downward along the rotation restricting rib 81. Thus the rotation restricting rib 81 also functions as a guide rib for the movement of the first stopper member 63 in the up-down direction.

Moreover, as the first stopper member 63 moves downward, the second stopper member 68, which makes contact with the pressing portion 63*b* of the first stopper member 63, is pressed downward. Thus, against the urging force of the coil spring 69, the second stopper member 68 moves downward. As a result, as shown in FIG. 16, the fourth O-ring 80*d* fitted on the second stopper member 68 moves apart from the circumferential edge part of the liquid passage port 65*c* in the coupling member 65, leaving also the second valve 67 open.

With the structure described above, as the first valve 61, which is disposed on the common flow passage 40, opens and closes, the second valve 67, which is disposed on the coupling member 65 (recording head 17*a* to 17*c*), opens and closes in an interlocked manner. That is, the first valve 61 disposed on the common flow passage 40 and the second valve 67 disposed on the coupling member 65 (recording head 17*a* to 17*c*) can be opened and closed at the same time, with a single operation. Thus, there is less risk of, for example, when the recording head 17*a* to 17*c* is removed from the head unit 51, the first or second valve 61 or 67 being unintendedly left open or, when the recording head 17*a* to 17*c* is attached to the head unit 51, the first or second valve 61 or 67 being unintendedly left closed.

It is thus possible to prevent leakage of ink or cleaning liquid resulting from replacing the recording heads 17*a* to 17*c* without closing the first or second valve 61 or 67. It is also possible to prevent printing failure resulting from unintendedly leaving the first or second valve 61 or 67 open after the replacement of the recording head 17*a* to 17*c*.

Here, after the first and second valves 61 and 67 are closed, ink or cleaning liquid may be left in the space between the first and second valves 61 and 67 (the space leading from the insertion hole 62*a* in the switch member 62 to the liquid passage port 65*c* in the coupling member 65). Thus, even when the recording head 17*a* to 17*c* is removed from the common flow passage 40 with the first and second valves 61 and 67 closed, the ink left between the first and second valves 61 and 67 may leak.

To cope with that, according to the embodiment, in the top surface of the coupling member 65 in the joint mechanism 60*a* to 60*c*, the liquid reservoir portion 73 is formed that has a volume equal to or greater than that of the space between the first and second valves 61 and 67. Thus, when the recording head 17*a* to 17*c* is removed from the common flow passage 40, the ink or cleaning liquid left between the first and second valves 61 and 67 is stored in the liquid reservoir portion 73. It is thus possible to prevent the interior of the printer 100 from being contaminated with leaking ink and cleaning liquid.

Figure 17:
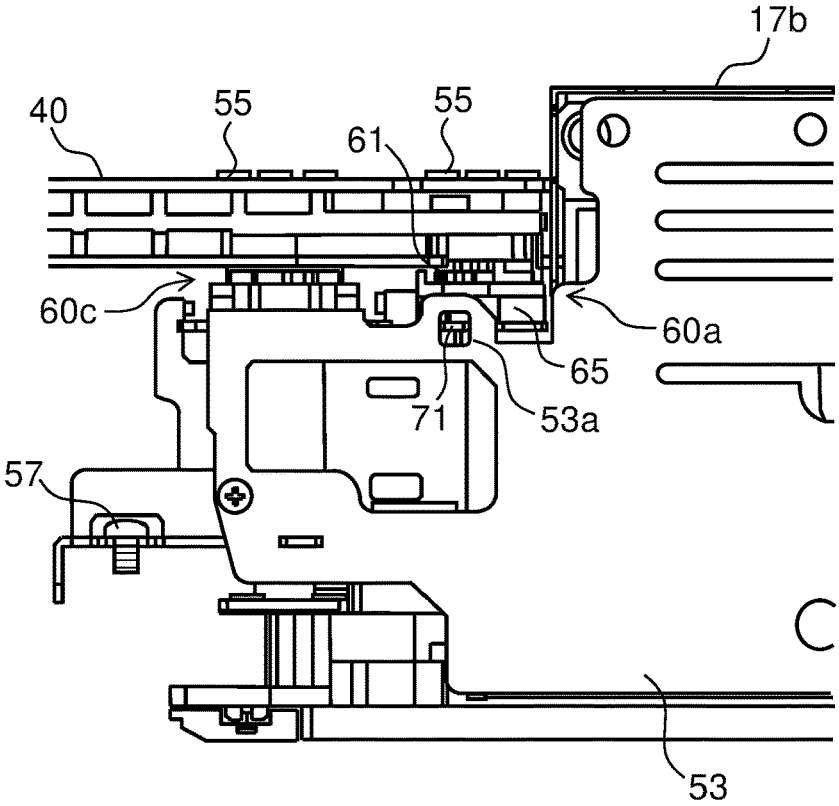
FIG. 17 is an enlarged view around the joint mechanism on a side surface of the recording head, showing a state where the joint mechanism is coupled.

3. Procedure for Attaching and Detaching the Recording Head: Next, a description will be given of the procedure for attaching and detaching the recording head 17*b* to 17*c*. FIG. 17 is an enlarged view around the joint mechanism 60*a* on a side surface of the recording head 17*b*. While the following description deals with the procedure for attaching and detaching the recording head 17*b*, the same procedure is applicable to the recording heads 17*a* and 17*c*.

To remove the recording head 17*b* from the common flow passage 40, first the lever portion 62*e* of the switch member 62 is operated so that, as shown in FIG. 15, the first and second valves 61 and 67 are closed. Next, the nine first fixing screws 55, of which every three are fastened to each of the joint mechanisms 60*a* to 60*c* at three locations, are removed. Removing the first fixing screws 55 releases the fastening of the coupling member 65 to the common flow passage 40, and the coupling member 65 is left held at the coupling position only under the urging force of the coil spring 69. The recording head 17*b* is fastened to the common flow passage 40 with the second fixing screws 57.

Next, the projection 71 on the support plate 65*b* that protrudes out through the opening 53*a* in the heatsink plate 53 is pressed down with a finger. As a result, the body portion 65*a*, to which the support plate 65*b* is fixed, is pressed down along with the support plate 65*b* against the urging force of the coil spring 69. Thus the coupling member 65 moves from the coupling position to a position (retracted position) retracted down from there.

Figure 18:
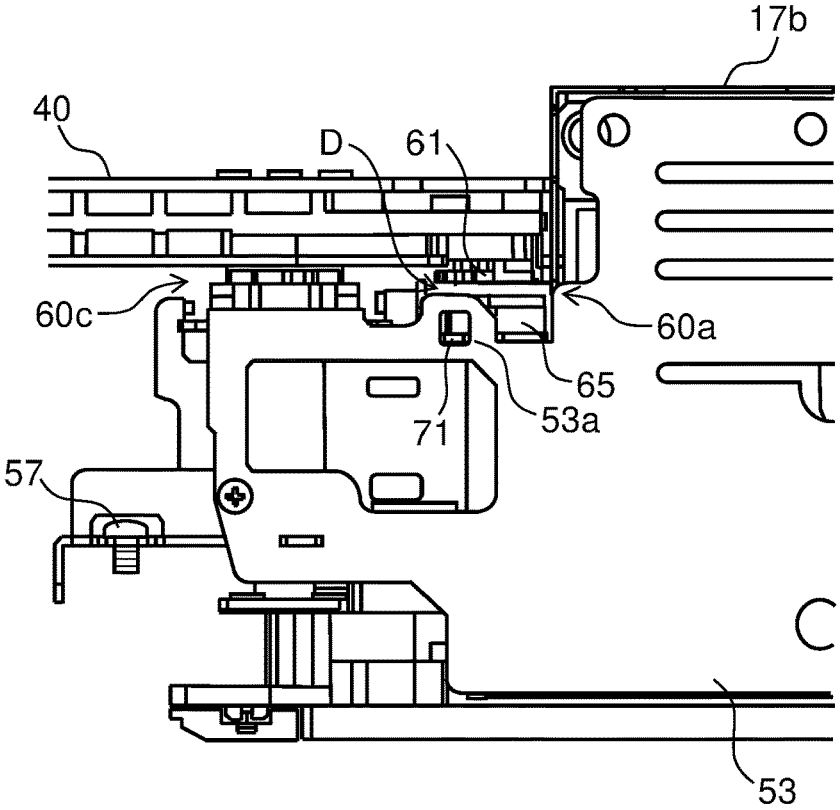
FIG. 18 is an enlarged view around the joint mechanism on the side surface of the recording head, showing a state where the coupling member has been moved to a retracted position from the state in FIG. 17.
Figure 19:
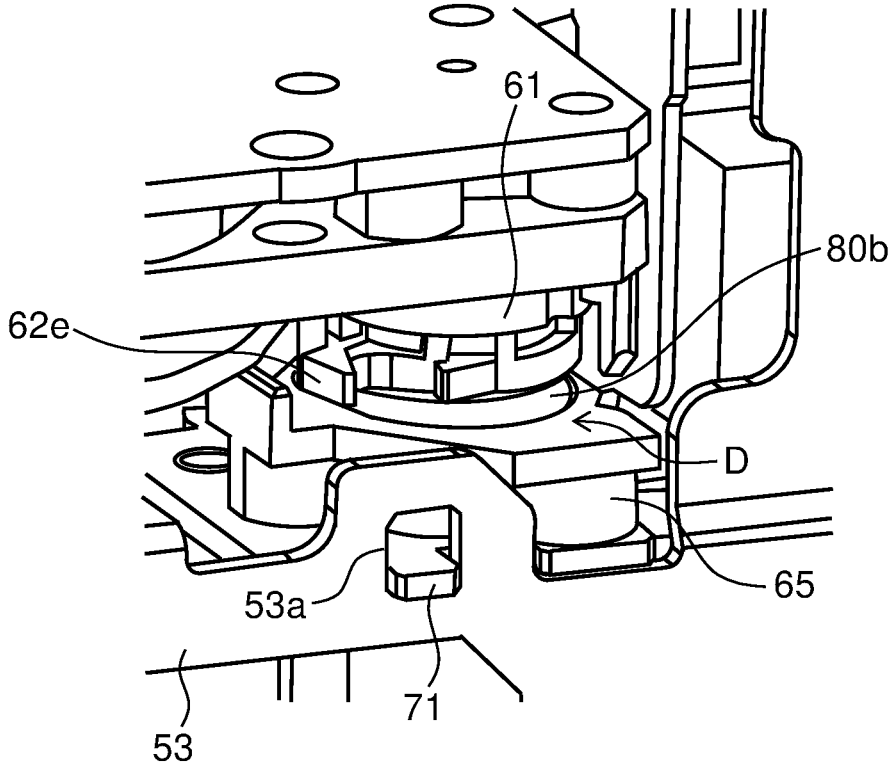
FIG. 19 is an enlarged perspective view of a gap between the first valve and the coupling member in FIG. 18.

FIG. 18 is a diagram showing a state where the coupling member 65 has been moved to the retracted position from the state in FIG. 17. FIG. 19 is an enlarged perspective view of the gap between the first valve 61 and the coupling member 65 in FIG. 18. As shown in FIGS. 18 and 19, as the coupling member 65 moves to the retracted position, a gap D appears between the first valve 61 and the coupling member 65.

With a piece of paper or cloth inserted in the gap D, the ink or cleaning liquid remaining between the first valve 61 and the coupling member 65 can be absorbed. The ink and cleaning liquid that is left unabsorbed with paper or cloth is stored in the liquid reservoir portion 73. After that, the second fixing screws 57 fastened at the left and right of the recording head 17*b* are removed, and the recording head 17*b* is removed from the common flow passage 40.

To fit the recording head 17*b* to the common flow passage 40, for all the joint mechanisms 60*a* to 60*c* at three locations, with the first valve 61 closed, the coupling member 65 is connected to the first valve 61. The first fixing screws 55 and the second fixing screws 57 are then fastened so that the recording head 17*b* is attached to the common flow passage 40. After that, the lever portion 62*e* of the switch member 62 in each of the joint mechanisms 60*a* to 60*c* is operated to open the first and second valves 61 and 67 to permit the feeding of ink and cleaning liquid to the recording head 17*b*.

With the first and second valves 61 and 67 closed, the lever portion 62*e* of the switch member 62 is so located as to interfere with the fastening of the first fixing screws 55. Thus, to fasten the first fixing screws 55, the lever portion 62*e* needs to be operated to open the first and second valves 61 and 67. That is, unless the first and second valves 61 and 67 are opened, the coupling member 65 cannot be attached.

It is thus possible to reliably open the first and second valves 61 and 67 when attaching the coupling member 65.

By attaching and detaching the recording head 17*a* to 17*c* through the procedure described above, it is possible to effectively prevent leakage of ink and cleaning liquid at the joint mechanisms 60*a* to 60*c* with a simple structure and by a simple operation.

The present disclosure can be implemented in any manner other than as specifically described above by way of an embodiment, and allows for various modifications without departure from the spirit of the present disclosure. For example, while the above embodiment deals with a construction where three recording heads 17*a* to 17*c* are attached to one head unit 51, also possible are constructions where only one recording head is attached to a head unit 51 and two, or four or more, recording heads are attached it.

While the above embodiment deals with an example where the recording heads 17*a* to 17*c* each include joint mechanisms 60*a* and 60*b* for the feeding of ink and a joint mechanism 60*c* for the feeding of cleaning liquid, the number and arrangement of joint mechanisms can be modified as necessary in accordance with the structure of recording heads and other considerations.

While the above embodiment deals with an example where as an inkjet recording apparatus a color printer that records a color image with inks of four colors is used, it is possible to employ a head unit according to the present disclosure equally in cases where a monochrome printer that records a monochrome image with black ink is used.

Figure 20:
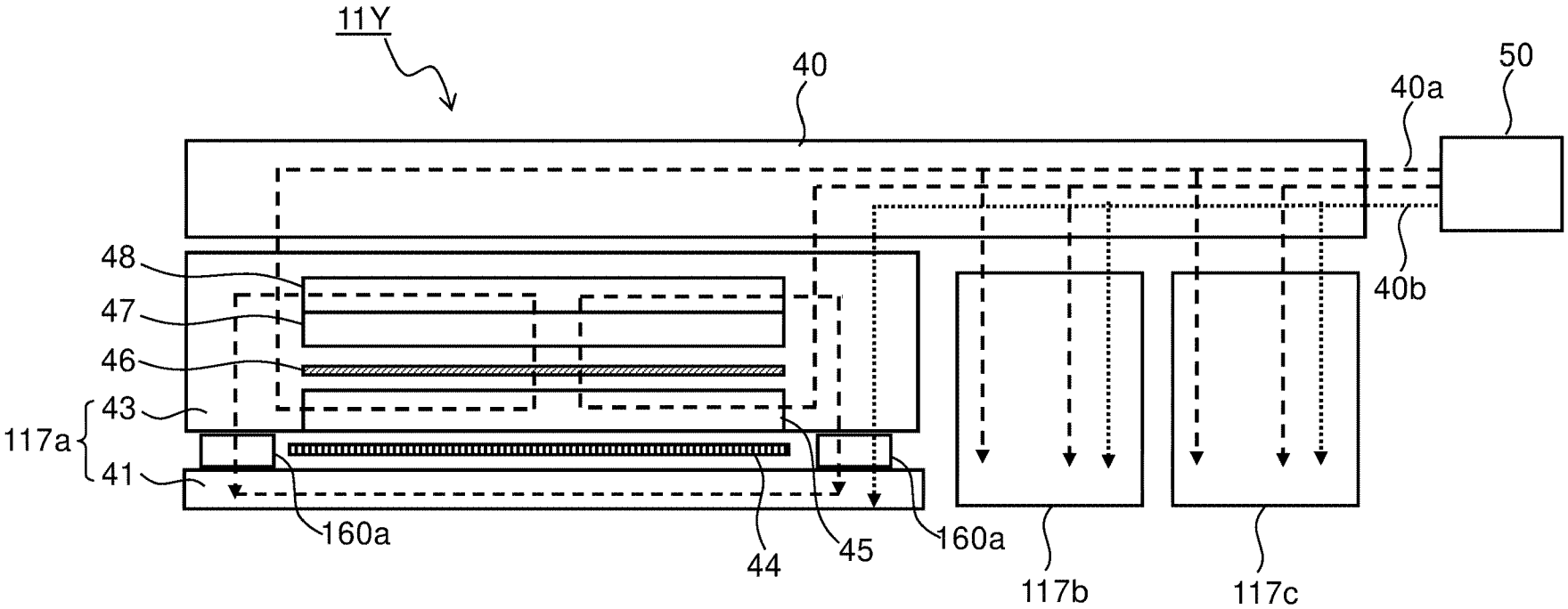
FIG. 20 is a schematic diagram showing another construction example of ink feed passages, a cleaning liquid feed passage, and the internal structure of recording heads in a line head in the printer.

FIG. 20 is a schematic diagram showing another construction example of the ink feed passages 40*a*, the cleaning liquid feed passage 40*b*, and the internal structure of recording heads 117*a* to 117*c* in the line head 11Y in the printer 100. For any features shared with what is shown in FIG. 5, no overlapping description will be repeated.

The recording head 117*a* to 117*c* has a head front portion 41, a head rear portion 43, a heater 44, and a joint mechanism 160*a*. The joint mechanism 160*a* connects together the head front portion 41 and the head rear portion 43. The joint mechanism 160*a* has an ink feed passage 40*a* and a cleaning liquid feed passage 40*b* through which ink and cleaning liquid pass. The joint mechanism 160*a* is provided one in each of opposite end parts of the recording head 117*a* to 117*c* in its longitudinal direction.

Figure 21:
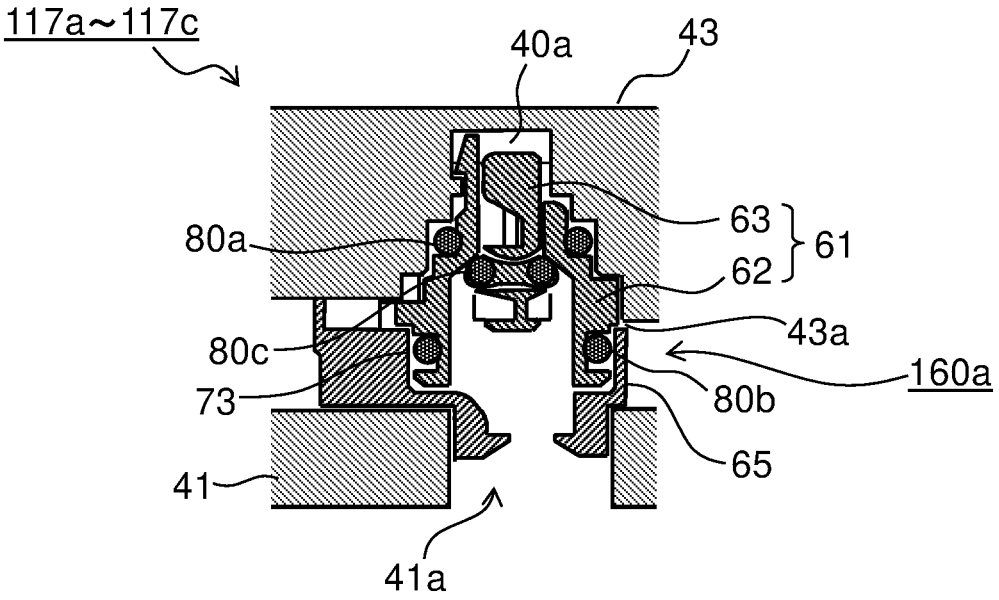
FIG. 21 is a sectional side view of the joint mechanism in FIG. 20.

FIG. 21 is a sectional side view of the joint mechanism 160*a* in FIG. 20. FIG. 21 shows the structure of the left-side joint mechanism 160*a* in FIG. 20 that connects the ink feed passage 40*a* in the head rear portion 43 to the head front portion 41. The right-side joint mechanism 160*a* in FIG. 20 is basically structured similarly except that it includes two first valves 61 for connecting together the ink feed passage 40*a* and the cleaning liquid feed passage 40*b*.

As shown in FIG. 21, the joint mechanism 160*a*, with one end of the first valves 61 connected to an opening 43*a* in the head rear portion 43, is fitted to the terminal end of the ink feed passage 40*a* of the common flow passage 40. Specifically, a switch member 62 in the first valve 61 is disposed over the opening 43*a* in the head rear portion 43. A first stopper member 63 in the first valve 61 is provided over the opening 43*a* in the head rear portion 43 to open and close the ink feed passage 40*a*. The other end of the first valves 61 is connected to a coupling member 65 fitted to an opening 41*a* in the head front portion 41. In a top end part of the coupling member 65, a liquid reservoir portion 73 is formed.

As described above, in this embodiment, the recording head 117*a* to 117*c* has the head front portion 41 and the head rear portion 43 coupled together with the joint mechanism 160*a*. Thus it is possible to prevent leakage of liquid when, with the head front portion 41 and the head rear portion 43 removed, the recording head 117*a* to 117*c* is replaced.

While the above description deals with an example where the head front portion 41 and the head rear portion 43 are coupled together with the joint mechanism 160*a*, this is not meant as any limitation. Instead, the head front portion 41 and the head rear portion 43 may be coupled together with the joint mechanism 60*a*. Also in that case, it is possible to prevent leakage of liquid when, with the head front portion 41 and the head rear portion 43 removed, the recording head 117*a* to 117*c* is replaced.

The present disclosure finds applications in inkjet recording apparatuses, such as inkjet printers, provided with attachable-detachable recording heads.

What is claimed is:

1. A head unit to be incorporated in an inkjet recording apparatus to record an image to a recording medium, the head unit comprising:

a common flow passage having a liquid feed passage through which to pass at least one kind of liquid including ink;

at least one recording head attachable and detachable to and from the common flow passage, the recording head having a plurality of nozzles through which to eject the ink; and a joint mechanism coupling the liquid feed passage to a liquid feed port in the recording head, the joint mechanism having a first valve, wherein the first valve includes:

a switch member having an insertion hole and an engagement boss projecting from an inner circumferential surface of the insertion hole;

a first stopper member having a sliding portion inserted in the insertion hole so as to be slidable up and down and an engagement groove formed with an inclination relative to an axial direction of the sliding portion so as to be engaged with the engagement boss; and a first sealing member attached to the first stopper member so as to be in contact with or away from the inner circumferential surface of the insertion hole, and rotating the switch member and thereby moving the first stopper member up and down causes the first valve to switch between a closed state where the first sealing member is in contact with the inner circumferential surface of the insertion hole and an open state where the first sealing member is away from the inner circumferential surface of the insertion hole.

2. The head unit according to claim 1, wherein the joint mechanism includes:

a coupling member coupling the first valve to the liquid feed port; and a second valve provided inside the coupling member, wherein as the first valve opens and closes, the second valve opens and closes in an interlocked manner.

3. The head unit according to claim 2, wherein the second valve includes:

a second stopper member protruding through a liquid passage port in the coupling member to make contact with the first stopper member;

a biasing member biasing the second stopper member in a direction toward the first stopper member; and a second sealing member attached to the second stopper member so as to be in contact with or away from a circumferential edge part of the liquid passage port, rotating the switch member and thereby moving the first stopper member up and down causes the second valve to switch between a closed state where the second sealing member is in contact with the circumferential edge part of the liquid passage port and an open state where the second sealing member is away from the circumferential edge part of the liquid passage port.

4. The head unit according to claim 2, wherein the switch member has a lever portion operated when the switch member is rotated, and the lever portion, with the first valve in the closed state, restrains screw-fastening of the coupling member and with the first valve in the open state, permits screw-fastening of the coupling member.

5. The head unit according to claim 2, wherein the coupling member is movable between a coupling position where the coupling member is coupled to the first valve and a retracted position where the coupling member is retracted from the coupling position, and with the coupling member located at the retracted position, a gap is left between the first valve and the coupling member.

6. The head unit according to claim 5, further comprising:

a first fixing screw for fixing the coupling member to the common flow passage; and a second fixing screw for fixing the recording head to the common flow passage, wherein with the second fixing screw fastened, removing the first fixing screw permits only the coupling member to move between the coupling position and the retracted position while the recording head remains fixed to the common flow passage.

7. The head unit according to claim 1, wherein the first valve has a guide groove in which a rotation restricting rib projecting from the common flow passage is inserted so that, when the switch member is rotated, the first valve is restrained from rotating by contact between the rotation restricting rib and the guide groove.

8. The head unit according to claim 5, wherein the guide groove is formed parallel to the axial direction of the sliding portion so that, as the rotation restricting rib slides along an inner wall surface of the guide groove, the first stopper member moves in an up-down direction along the rotation restricting rib.

9. The head unit according to claim 1, wherein the switch member has an engagement claw that engages with an engaged portion in the common flow passage.

10. An inkjet recording apparatus comprising:

the head unit according to claim 1; and a liquid feeding mechanism for feeding the liquid to the head unit.

11. A recording head to be incorporated in an inkjet recording apparatus to record an image to a recording medium, the recording head comprising:

a head front portion having a plurality of nozzles;

a head rear portion having a liquid feed passage through which to pass at least one kind of liquid including ink, the head rear portion feeding the liquid to the head front portion;

a joint mechanism coupling together the head front portion and the head rear portion, the joint mechanism having a first valve that opens and closes the liquid feed passage, wherein the first valve includes:

a switch member having an insertion hole and an engagement boss projecting from an inner circumferential surface of the insertion hole;

a first stopper member having a sliding portion inserted in the insertion hole so as to be slidable up and down and an engagement groove formed with an inclination relative to an axial direction of the sliding portion so as to be engaged with the engagement boss; and a first sealing member attached to the first stopper member so as to be in contact with or away from the inner circumferential surface of the insertion hole, and rotating the switch member and thereby moving the first stopper member up and down causes the first valve to switch between a closed state where the first sealing member is in contact with the inner circumferential surface of the insertion hole and an open state where the first sealing member is away from the inner circumferential surface of the insertion hole.

12. A head unit comprising:

the recording head according to claim 11; and a common flow passage having the liquid feed passage.

13. An inkjet recording apparatus comprising:

the head unit according to claim 12; and a liquid feeding mechanism for feeding the liquid to the head unit.

* * * * *